United States Patent [19]

Colman et al.

[11] 4,251,368

[45] Feb. 17, 1981

[54] CYCLONE SEPARATOR

[75] Inventors: Derek A. Colman, Lordswood; Martin T. Thew, Bitterne, both of England

[73] Assignee: National Research Development Corporation, London, England

[21] Appl. No.: 42,226

[22] Filed: May 24, 1979

[30] Foreign Application Priority Data

May 31, 1978 [GB] United Kingdom ..... 25883/78

[51] Int. Cl.[3] ..... B04C 5/081

[52] U.S. Cl. ..... 210/788; 210/512.1

[58] Field of Search ..... 210/84, 252, 261, 262, 210/322, 512 R, 512 M

[56] References Cited

U.S. PATENT DOCUMENTS

| | | | |
|---|---|---|---|
| 3,052,361 | 9/1962 | Whatley et al. | 210/512 M |
| 3,396,511 | 8/1968 | Fracke et al. | 210/512 R |
| 3,850,816 | 11/1974 | Koch | 210/512 R |
| 3,971,718 | 7/1976 | Reid | 210/512 R |

OTHER PUBLICATIONS

High Efficiency Cyclone Dust Collectors by Greenfield in Filtration and Separation, vol. 10, No. 3, May/-Jun. 1973.

*Primary Examiner*—John Adee

*Attorney, Agent, or Firm*—Cushman, Darby & Cushman

[57] ABSTRACT

A cyclone separator having a generally cylindrical first portion with a plurality of substantially equally circumferentially spaced tangentially directed feeds, and, adjacent to the first portion and coaxial therewith, a generally cylindrical second portion open at its far end, the first portion having an axial overflow outlet opposite the second portion, the internal diameter of the first portion being $d_1$, and of the second portion being $d_2$, and of which the internal length of the first portion is $L_1$ and of the second portion is $L_2$, the total cross-sectional area of all the feeds measured at the point of entry normal to the inlet flow being $A_i$, the shape of the separator being governed by the following relationships:

$$15 \leq l_1/d_1 \leq 40$$

$$0.1 \leq 4A_i/\pi_1^2 \leq 0.2$$

$$0.1 \leq d_o/d_1 \leq 0.25$$

$$1.2 \leq d_1/d_2 \leq 3.$$

14 Claims, 1 Drawing Figure

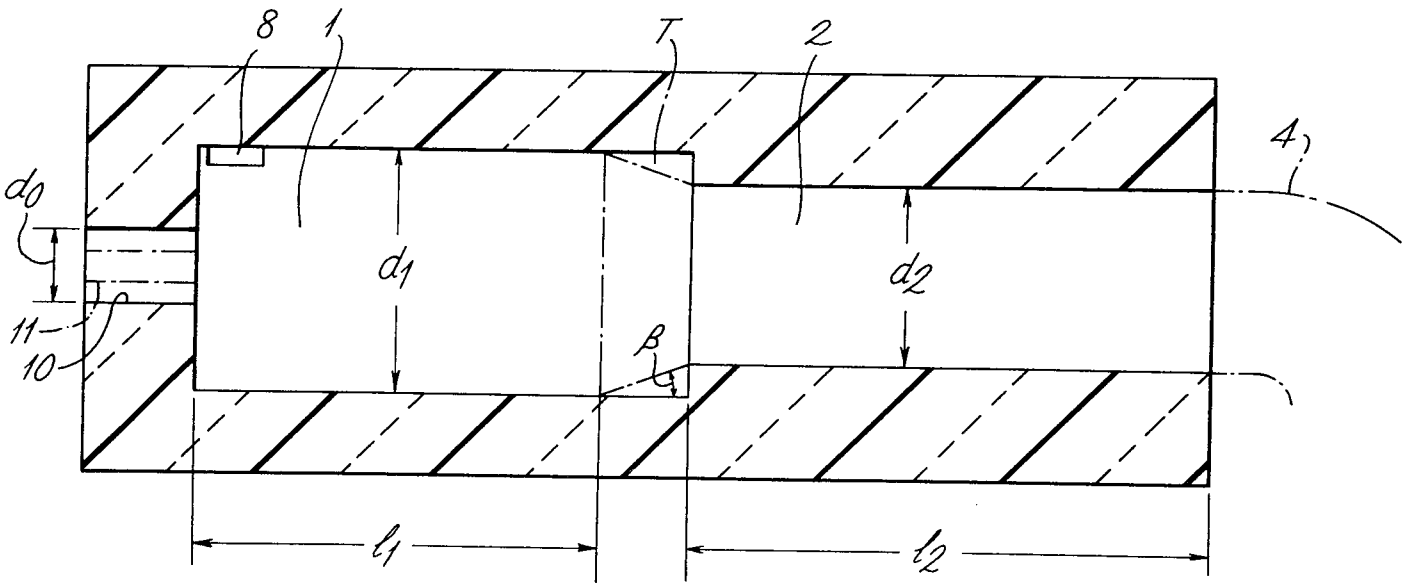
4
2
T
8
1
d0
11
10
d1
d2
B
l1
l2

CYCLONE SEPARATOR

This invention is about a cyclone separator. This separator may find application in removing a lighter phase from a large volume of a denser phase, such as oil from water, with minimum contamination of the more voluminous phase. Most conventional separators are designed for the opposite purpose, that is removing a denser phase from a large volume of a lighter phase, with minimum contamination of the less voluminous phase.

This invention is a cyclone separator defined as follows. The cyclone separator has a generally cylindrical first portion with a plurality of substantially equally circumferentially spaced tangentially directed feeds, and, adjacent to the first portion and coaxial therewith, a generally cylindrical second portion open at its far end. The first portion has an axial overflow outlet opposite the second portion. The internal diameter of the axial overflow outlet is $d_0$, of the first portion is $d_1$ and of the second portion is $d_2$. The internal length of the first portion is $l_1$ and of the second portion is $l_2$. The total cross-sectional area of all the feeds measured at the points of entry normal to the inlet flow is $A_i$. The shape of the separator is governed by the following relationships:

$$15 \leq l_1/d_1 \leq 40$$

$$0.1 \leq 4A_i/\pi d^2_1 \leq 0.2$$

$$0.1 \leq d_0/d_1 \leq 0.25$$

$$1.2 \leq d_1/d_2 \leq 3.$$

For maximum discrimination with especially dilute lighter phases, a temptation might be to minimise $d_0$ but, if overdone, this is undesirable, and it is better to provide, within the axial overflow outlet of diameter $d_0$ defined above, a further concentric outlet tube of the desired narrowness. Material leaving by the axial overflow outlet and not by its concentric outlet tube may be returned to the cyclone separator for further treatment, via any one or more of the feeds. Preferably $l_2/d_2$ is at least 15, more preferably at least 40.

Preferably $d_1/d_2$ is from 1.5 to 2.5.

Optionally, there may be interposed, between the inlet portion and the separating portion, a flow-smoothing taper, described more fully later.

Although it is a matter of choice, it is generally convenient to arrange the cyclone separator size to fall within the range $d_1 = 10$ to 100 mm. If this appears too small for high-volume applications, it will usually be preferred to provide several smaller cyclones in parallel, rather than one huge one, to deal with the volume.

The invention extends to a method of removing a lighter phase from a larger volume of a denser phase, comprising applying the phases to the feeds of a cyclone separator as set forth above, the phases being at a higher pressure than the axial overflow outlet and the far end of the second portion.

This method is particularly envisaged for removing oil (lighter phase) from water (denser phase), such as sea water, which may have become contaminated with oil, as a result of spillage, shipwreck, oil-rig blow-out or routine operations such as bilge-rinsing or oil-rig drilling.

As liquids normally become less viscous when warm, water for example being only half as viscous at 50° C. as at 20° C., the method is advantageously performed at as high a temperature as convenient.

The invention extends to the products of the method (such as concentrated oil, or cleaned water).

The invention will now be described by way of example with reference to the accompanying drawing, which shows, schematically, a cyclone separator according to the invention. The drawing is not to scale.

A generally cylindrical first portion 1 has two equally-circumferentially-spaced feeds 8 (only one shown) which are directed tangentially, both in the same sense, into the first portion 1. Coaxial with the first portion 1, and adjacent to it, is a generally cylindrical second portion 2, which opens at its far end into collection ducting 4.

The first portion 1 has an axial overflow outlet 10 opposite the second portion 2, and in one embodiment this contains a narrower concentric outlet tube 11.

In the present cyclone separator, the actual relationships are as follows:

$d_1/d_2 = 2$. This is a compromise between energy-saving and space-saving considerations, which on their own would lead to ratios of around 2.5 and 1.5 respectively.

$l_1/d_1 = 30$. The first portion 1 should not be too long.

$l_2/d_2 = 42.5$. This ratio should be as large as possible.

$d_0/d_1 = 0.14$. If this ratio is too large, too much of the denser phase overflows with the lighter phase through the axial overflow outlet 10. If the ratio is too small, the vortex may be disturbed, and for separating minute proportions of a lighter phase the outlet tube 11 may be employed within the outlet 10 of the above diameter. With these exemplary dimensions, about 10% by volume of the material treated in the cyclone separator overflows through the axial overflow outlet 10.

$d_1 = 30$ mm. This depends on the use of the cyclone separator. For separating oil from water, $d_1$ may conveniently be 20 mm, but $d_1$ can for many purposes be anywhere within the range 10–100 mm, for example 15–60 mm; with excessively large $d_1$, the energy consumption becomes large, while with too small $d_1$ Reynolds number effects and excessive shear stresses arise.

$4A_i/\pi d^2_1 = \frac{1}{8}$. That is, the inlet area of both the circumferentially-spaced openings of the feeds 8 totals $\frac{1}{8}$ of the cross-sectional area of the first portion 1 (taken on a section perpendicular to the axis). A range of 0.1 to 0.2 is however quite permissible.

The ratio of the radial to the axial extent of the opening of each feed 8 is 1:3, and although this may be achieved by drilling three adjacent holes it can also be as shown, by machining a rectangular opening. The opening should begin within about $d_1/3$ of the overflow end wall of the first portion 1. This ratio may reach 1:4.5, but is less successful when approaching 1:2. The number of circumferentially spaced feeds is two but may equally successfully be three.

To separate oil from water, the oil/water mixture is introduced for example at 50° C. through the feeds 8 at a pressure exceeding that in the ducting 4 or in the axial overflow outlet 10 (including the outlet tube 11 if present). The mixture spirals within the first portion 1.

The bulk of the oil accordingly separates within an axial vortex in the first portion 1. The spiralling flow of the water plus remaining oil then enters the second portion 2. The remaining oil separates within a continuation of the axial vortex in the second portion 2. The cleaned water leaves through the collection ducting 4 and may be collected, for return to the sea, for example.

The oil entrained in the vortex moves axially to the axial overflow outlet 10 and may be collected for dumping, storage or further separation, since it probably still contains some water. If the outlet tube 11 is present, this more selectively collects the oil, and the material issuing from the outlet 10 other than through the tube 11 may be recycled to the feeds 8 (at its original pressure).

Advantageously, there may be interposed, between the first portion 1 and the second portion 2, a flow-smoothing taper T which may have the form of a frustoconical internal surface whose larger-diameter end has a diameter $d_1$ and whose smaller-diameter end has a diameter $d_2$. The conicity (half-angle), in other words the angle (shown as $\beta$) which the taper makes with the axis, is preferably from 5° to 90°, more preferably at least 10°, and in the above example is 10°.

We claim:

1. A cyclone separator, having:

an internally generally cylindrical first portion with a plurality of substantially equally-angularly spaced tangentially directed feeds, and, axially adjacent to the cylindrical first portion but for an annular transitional internal surface means providing a step and coaxial therewith, an internally generally cylindrical second portion open at its far end thereby providing a denser-phase outlet, the cylindrical second portion being characterized by the absence of feed inlets except over said step from said cylindrical first portion, the cylindrical first portion having an axial overflow outlet for less dense phase at its far end distally of the cylindrical second portion, the internal shape of the separator being governed by the following relationships:

$$15 \leq l_1/d_1 \leq 40$$

$$0.1 \leq 4A_i/\pi d^2_1 \leq 0.2$$

$$0.1 \leq d_0/d_1 \leq 0.25$$

$$1.2 \leq d_1/d_2 \leq 3,$$

the internal diameter of the axial overflow outlet being $d_0$; the internal diameter of the cylindrical first portion being $d_1$, and of the cylindrical second portion being $d_2$, and of which the internal length of the cylindrical first portion is $l_1$ and of the cylindrical second portion is $l_2$, the total cross-sectional area of all said feeds measured at the point of entry normal to the inlet flow being $A_i$.

2. A cyclone separator according to claim 1, wherein $l_2/d_2$ is at least 15.

3. A cyclone separator according to claim 2, wherein $l_2/d_2$ is at least 40.

4. A cyclone separator according to claim 1, wherein $d_1/d_2$ is from 1.5 to 2.5.

5. A cyclone separator according to claim 1, wherein the axial overflow outlet further comprises a coaxial outlet tube of diameter less than $d_0$.

6. A cyclone separator according to claim 1, wherein $d_1$ is from 10 to 100 mm.

7. A cyclone separator according to claim 1, wherein the ratio of the radial to the axial extent of each of the feeds is from 2:1 to 4.5:1.

8. A cyclone separator according to claim 1, wherein said annular transitional internal surface means comprises: a flow-smoothing taper interposed between the first portion and the second portion.

9. A cyclone separator according to claim 8, wherein the flow-smoothing taper has the form of a frustoconical internal surface whose larger-diameter end has a diameter $d_1$ and whose smaller-diameter end has a diameter of $d_2$.

10. A cyclone separator according to claim 9, wherein the conicity (half-angle) of the flow-smoothing taper is from 5° to 90°.

11. A cyclone separator according to claim 10, wherein the conicity (half-angle) of the flow-smoothing taper is at least 10°.

12. A method for removing a less dense liquid phase from a relatively large volume of more dense liquid phase, comprising:

injecting a mixture of the two phases through a plurality of substantially equally-angularly spaced tangential feeds into the internally generally cylindrical first portion of a cyclone separator which also has, axially adjacent to the cylindrical first portion but for an annular transitional internal surface means providing a step, and coaxial with said cylindrical first portion, an internally generally cylindrical second portion open at its far end distally of said cylindrical first portion to provide a denser-phase outlet, this cylindrical second portion being characterized by the absence of feed inlets except over said step from said cylindrical first portion, the cylindrical first portion having an axial overflow outlet for the less dense phase at its far end distally of the cylindrical second portion, wherein the internal shape of said separator is governed by the following relationships $$15 \leq l_1/d_1 \leq 40$$

$$0.1 \leq 4A_i/\pi d^2_1 \leq 0.2$$

$$0.1 \leq d_0/d_1 \leq 0.25$$

$$1.2 \leq d_1/d_2 \leq 3,$$

in which:

$d_0$ = the internal diameter of the overflow outlet, $d_1$ = the internal diameter of the cylindrical first portion, $d_2$ = the internal diameter of the cylindrical second portion, $l_1$ = the internal length of the cylindrical first portion, $l_2$ = the internal length of the cylindrical second portion, and $A_i$ = the total cross-sectional area of all said feeds measured at the point of injection, normal to inlet flow; and collecting less dense phase leaving the cyclone separator via the axial overflow outlet for the less dense phase;

the pressure of injection at said feeds being greater than the pressure at said axial overflow outlet and greater than the pressure at said denser-phase outlet.

13. A method according to claim 12, wherein the lighter phase is oil and the denser phase is water.

14. A method according to claim 12, further comprising:

coaxially providing said axial overflow outlet with an outlet tube having an external diameter that is substantially smaller than $d_0$, thereby dividing said axial overflow outlet into a central portion which is located centrally of the outlet tube and a radially outer portion which is located circumferentially of the exterior of the outlet tube; and recycling to said feeds the liquid out flow of said radially outer portion of said axial overflow outlet.

* * * * *